US009096414B2

(12) United States Patent
Morath

(10) Patent No.: US 9,096,414 B2
(45) Date of Patent: Aug. 4, 2015

(54) CRANE CONTROL SYSTEM

(75) Inventor: Erwin Morath, Ehingen-Lauterach (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 456 days.

(21) Appl. No.: 13/559,012

(22) Filed: Jul. 26, 2012

(65) Prior Publication Data

US 2013/0026123 A1 Jan. 31, 2013

(30) Foreign Application Priority Data

Jul. 28, 2011 (DE) ..... 10 2011 108 851

(51) Int. Cl.

| | |
|---|---|
| ***F15B 11/17*** | (2006.01) |
| ***B66C 13/20*** | (2006.01) |
| *F15B 21/08* | (2006.01) |

(52) U.S. Cl.

CPC ..... *B66C 13/20* (2013.01); *F15B 11/17* (2013.01); *F15B 21/087* (2013.01); *F15B 21/082* (2013.01); *Y10T 137/85986* (2015.04)

(58) Field of Classification Search

CPC ..... F15B 11/17; F15B 21/087; F15B 21/082
USPC ..... 60/422, 484, 486, 445, 452
See application file for complete search history.

(56) References Cited

U.S. PATENT DOCUMENTS

| | | | | |
|---|---|---|---|---|
| 4,768,339 | A * | 9/1988 | Aoyagi et al. | 60/428 |
| 5,211,014 | A * | 5/1993 | Kropp | 60/421 |
| 5,692,377 | A * | 12/1997 | Moriya et al. | 60/421 |
| 6,799,424 | B2 * | 10/2004 | Ioku et al. | 60/486 |
| 7,350,353 | B2 * | 4/2008 | Ioku | 60/486 |
| 7,520,130 | B2 * | 4/2009 | Tanaka et al. | 60/421 |
| 7,665,620 | B2 * | 2/2010 | Morath | 212/276 |
| 8,720,196 | B2 * | 5/2014 | Kawasaki et al. | 60/452 |
| 2006/0266029 | A1 * | 11/2006 | Asakage et al. | 60/486 |

FOREIGN PATENT DOCUMENTS

| | | | |
|---|---|---|---|
| CN | 201670659 | U | 12/2010 |
| DE | 3901207 | A1 | 7/1990 |
| DE | 112009001293 | T5 | 4/2011 |
| EP | 0422821 | A1 | 4/1991 |
| EP | 0481120 | A1 | 4/1992 |
| EP | 1176115 | A1 | 1/2002 |
| EP | 2151526 | A1 | 2/2010 |
| JP | 2008014405 | A | 1/2008 |
| JP | 2011052372 | A | 3/2011 |

* cited by examiner

*Primary Examiner* — Thomas E Lazo
(74) *Attorney, Agent, or Firm* — Alleman Hall McCoy Russell & Tuttle LLP

(57) ABSTRACT

The present invention relates to a crane control system for controlling and/or for the hydraulic supply of hydraulic loads of a crane, as well as a crane having at least one crane control system.

20 Claims, 5 Drawing Sheets

CRANE CONTROL SYSTEM

CROSS-REFERENCE TO RELATED APPLICATION

This application claims priority to German Patent Application No. 10 2011 108 851.6, entitled "Crane Control System", filed Jul. 28, 2011, which is hereby incorporated by reference in its entirety for all purposes.

TECHNICAL FIELD

The present invention relates to a crane control system for controlling and/or for the hydraulic supply of hydraulic loads of a crane, as well as a crane having at least one crane control system.

BACKGROUND AND SUMMARY

Crane control systems are known for cranes having crane actuators that can be hydraulically actuated by a so-called load sensing system. This allows different crane operations to be carried out independent of one another. The controller determines the pressure that is required by each crane actuator and calculates the maximum required pressure. The controller thereupon automatically sets the hydraulic pump to the calculated pressure.

This relates to safe and robust operation. The respective crane actuators can then be supplied with the hydraulic medium through proportional valves.

In the load-sensing system according to the prior art (also see FIG. 2), most loads are connected together hydraulically in the open hydraulic circuit. Only the rotating mechanism is separated, since it must also be operated in the "closed hydraulic circuit" mode.

However, each crane actuator requires an individual hydraulic pressure and an individual hydraulic flow rate.

The luffing cylinder typically requires a high hydraulic pressure, and a winch frequently requires a high hydraulic oil flow rate.

If the luffing mechanism requires 330 bar and 100 l/min and the winch, for example, a pressure of 60 bar and a hydraulic oil flow rate of 200 l/min, then the hydraulic pressure must be reduced in the proportional valve assigned to the winch. The difference between 300 bar−60 bar=240 bar is then reduced in the proportional valve and converted into heat. The power that is converted into heat in this case is approx. 80 kW. The following formula can be used in practice:

$$P[\mathrm{kW}] = \frac{PressureDifference[\mathrm{bar}] * VolumeFlowRate[l/\mathrm{min}]}{600}$$

It is clear that the "losses" become larger the greater the pressure difference and the greater the volumetric flow rate.

Thus the object of the present invention is to improve upon a crane control system of the type indicated here in an advantageous manner.

This objective is achieved according to the invention by a crane control system for controlling and/or for the hydraulic supply of hydraulic loads of a crane, having at least one first pump means and at least a second pump means, at least one first split control block and at least one second split control block is provided by means of which at least one hydraulic load of the crane can be respectively supplied with hydraulic medium, wherein the first pump means is connected to the first split control block and can be driven at a first hydraulic pressure, and wherein the second pump means is connected to the second split control block and can be driven at a second hydraulic pressure.

This gives rise to the advantage, in particular, that the first hydraulic load of a crane that must be supplied with the hydraulic medium at a low or relatively low operating pressure can be supplied without a corresponding reduction in the operating pressure of the hydraulic medium, for example, by the first pump means and the first split control block. In addition, a second hydraulic load, which must be supplied with hydraulic medium at a high or relatively high operating pressure, can be supplied directly at the appropriate operating pressure of the hydraulic medium, for example, by the second pump means and the second split control block.

It can be provided that at least one valve means is arranged or provided between the first split control block and the second split control block, by means of which the first split control block and the second split control block can be hydraulically connected and/or separated. A hydraulic short circuit can advantageously be produced by opening it, so that, for example, more rapid crane operations are possible if needed. In this case the previously mentioned power losses must be accepted as a consequence of the necessary pressure reduction.

It is also possible that at least one switching means is provided by which the valve means can be actuated. The crane operator can be cognizant of the energy saving crane control system that has changeover control blocks that are separated from one another by the valve means, i.e., not switching hydraulically short circuited changeover control blocks, through the switching means, which can be a switch or a so-called "economy switch". Splitting into the at least two changeover control blocks can thereby be activated by the crane operator when the instantaneous situation enables energy to be saved. The crane operator activates the "economy switch" directly in this case in order to turn on the energy saving function. If the crane operator knows in advance that he often requires high volumetric flow rates of the hydraulic medium for continuous lifting operations with the crane, based on the necessary actuation of hydraulic loads of the crane at high operating pressures of the hydraulic medium, the economy switch is not activated, or is suitably switched or deactivated.

In addition, it can also be provided that at least one third pump means and at least one third split control block is provided, by which at least one hydraulic load of the crane can be supplied with hydraulic medium, wherein the third pump means is connected to the third split control block and can be driven by a third hydraulic pressure.

It is furthermore possible that at least one second valve means is arranged or provided between the third split control block and the first split control block and/or the second split control block, by which the third split control block can be hydraulically connected and/or disconnected from the first split control block and/or the second split control block.

It is also possible that at least one additional switching means is provided by means of which the second valve means can be actuated and/or that it is also possible to actuate the second valve means through the switching means by which the valve means can be actuated.

It can be provided that at least one crane control element, in particular a crane controller, is provided by which the at least one first hydraulic pressure and/or the at least one second hydraulic pressure is adjustable, wherein it is further advantageously provided that the third hydraulic pressure can be adjusted by the crane control system.

In addition, it is possible that the first or second hydraulic pressures can be equalized by the crane control element, wherein the respective lower hydraulic pressure can advantageously be equalized to the higher hydraulic pressure and thereby increased.

Furthermore, it can be provided that the respective at least one hydraulic load of the crane is a crane actuator, wherein the crane actuator is in particular a rotating mechanism, a luffing cylinder, a winch, a telescoping drive mechanism and/or a caterpillar drive.

Hydraulic loads, and thus crane actuators, can in particular be luffing cylinders, telescoping cylinders, caterpillar drives, auxiliary loads (e.g., luffing or telescoping of the cabin arms, ballast cylinders) and/or winches for lifting operations or luffing mechanisms.

In addition, the present invention relates to a crane having the features of claim 10. It is accordingly provided that the crane is provided with at least one crane control system according to one of the claims 1 to 9. The crane can, for example, be a mobile crane.

Additional details and advantages of the invention will now be explained with the aid of the embodiments shown in greater detail in the drawings.

DETAILED DESCRIPTION

Figure 1:
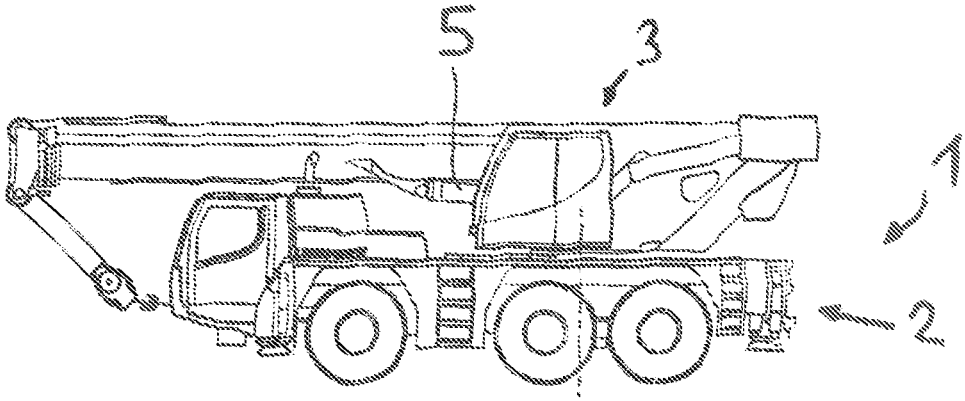
FIG. 1 a schematic side view of a mobile crane.

FIG. 1 shows a schematic side view of a crane with a crane control system according to the invention. Such a crane 1 has a revolving superstructure 3 and an undercarriage 2 having a plurality of crane actuators, for example like a rotating mechanism 4, a luffing cylinder 5 or a lifting unit 6 and a telescoping drive mechanism 7.

Various transducers 8 and input and output units 9 are provided here with touch displays 9 and a so-called LICCON-display screen 9 with readout and input means, as well as a crane controller (10). It is immaterial whether the crane 8 is of the single or double motor type.

For example, if we are considering a single motor crane, then the energy is transferred from the undercarriage 2 through the rotational lead-through 11 to the revolving superstructure 3. In the case of a two motor crane, the rotational lead-through 11 is eliminated.

The crane also has an internal combustion engine, specifically a diesel engine 12. This internal combustion engine 12 directly or indirectly drives the various pumps 13. At least one pump 13 is provided in principle. The pumps 13 of the crane actuators for the load-sensing system are part of an open hydraulic circuit.

Figure 2:
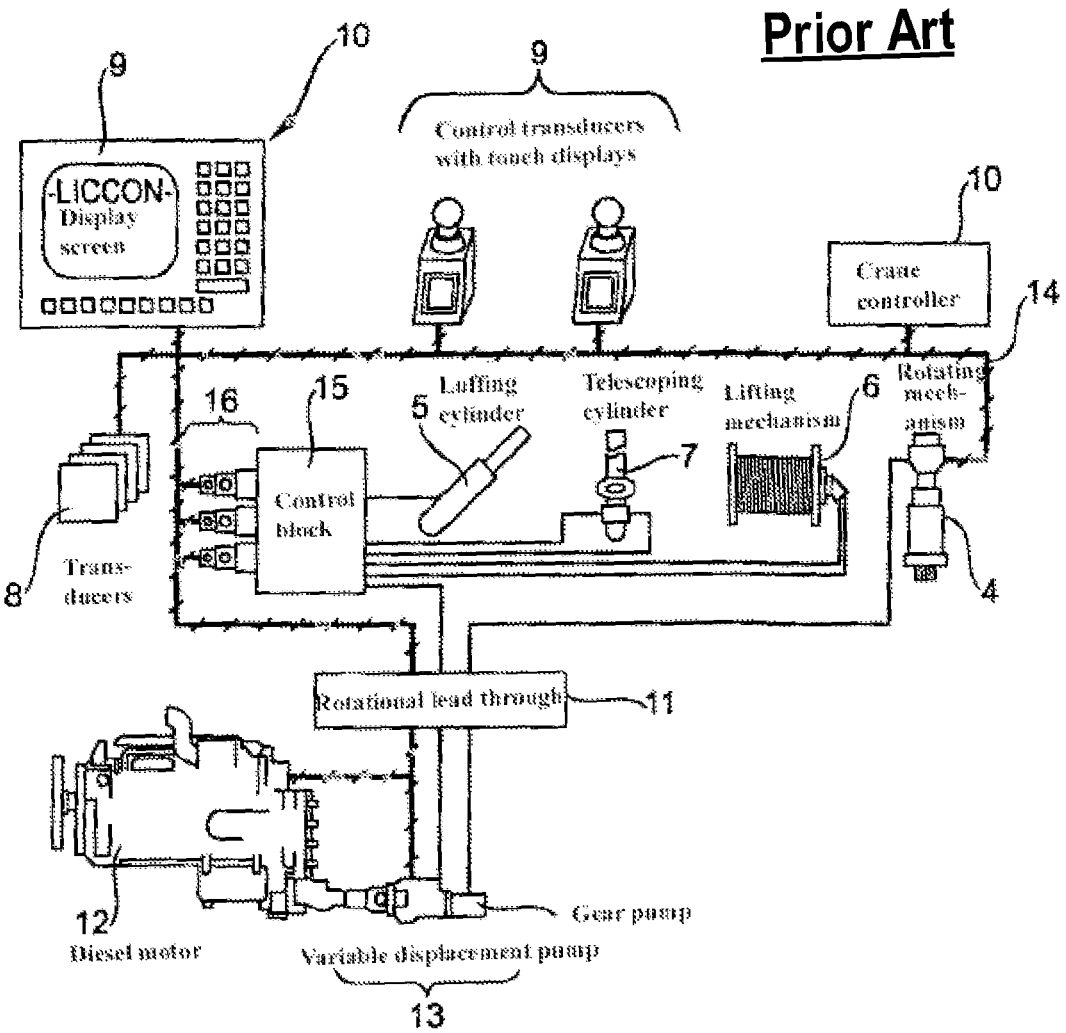
FIG. 2 a schematic view of a crane control system according to the prior art.

The bus system 14 for data and energy transmission is shown by a hatched line in FIG. 2. A control block 15 is also present, which supplies the crane actuators with the hydraulic medium. The volumetric flow rate Q and hydraulic pressure p are adjusted individually for each crane actuator in the control block through the controlled proportional valve 16. A pressure compensator is also present.

FIG. 2 shows a schematic view of a crane control system according to the prior art. In the system shown in FIG. 2, the solution according to the invention cannot be implemented because only one pump 13 is available for the load-sensing system, as has already been described. The pump 13 is a variable displacement pump 13 and can be a gear pump, which is coupled to the diesel engine 12 and driven by it.

However, if a crane 1 is available that has two or more pumps 13 for the load-sensing system due to its power consumption, then the system of FIG. 2 is employed according to the prior art, and this results in the previously described problem of "power loss".

Figure 3:
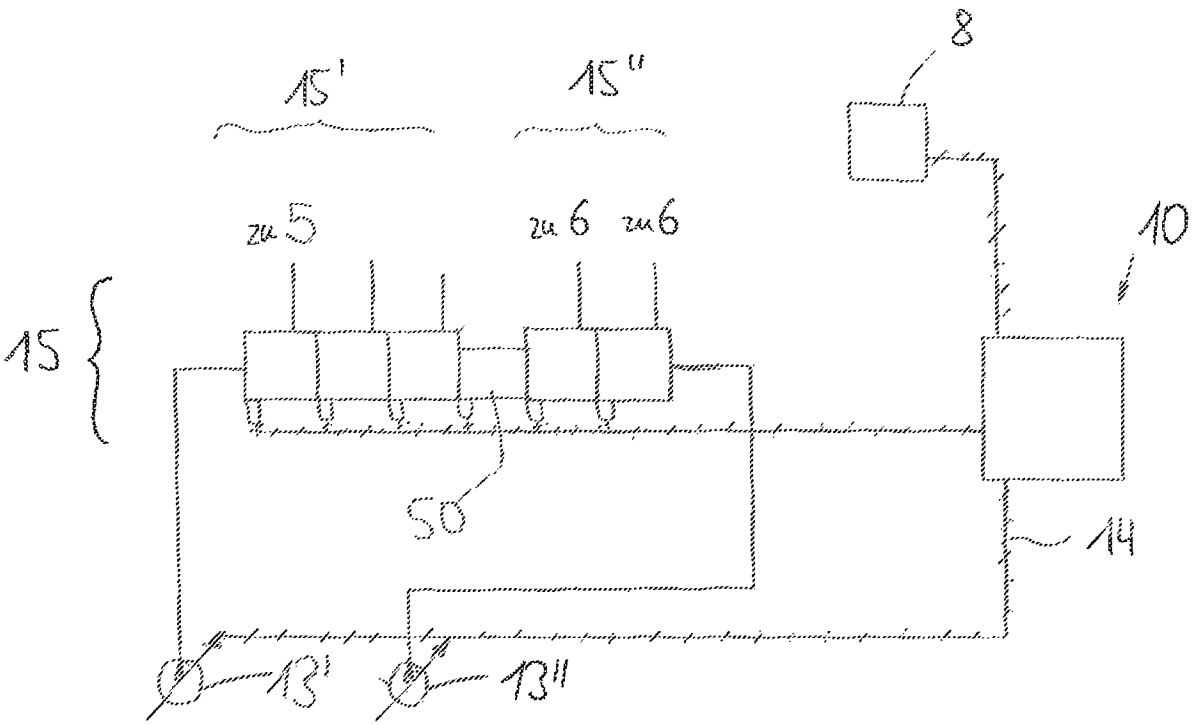
FIG. 3: a schematic view of the crane control system according to the invention.

FIG. 3 now schematically shows the crane control system according to the invention, which can also be designated as a load-sensing system, namely in particular as a "combined load-sensing pump controller."

At least two pumps 13' and 13" are additionally provided for the pump 13 for the rotating mechanism 4 to supply the crane actuators. The previously described pressure compensator is also present. However, at least one valve 50 is built into the control block that can divide the entire control block 15 into at least two split control blocks 15' and 15".

Figure 4:
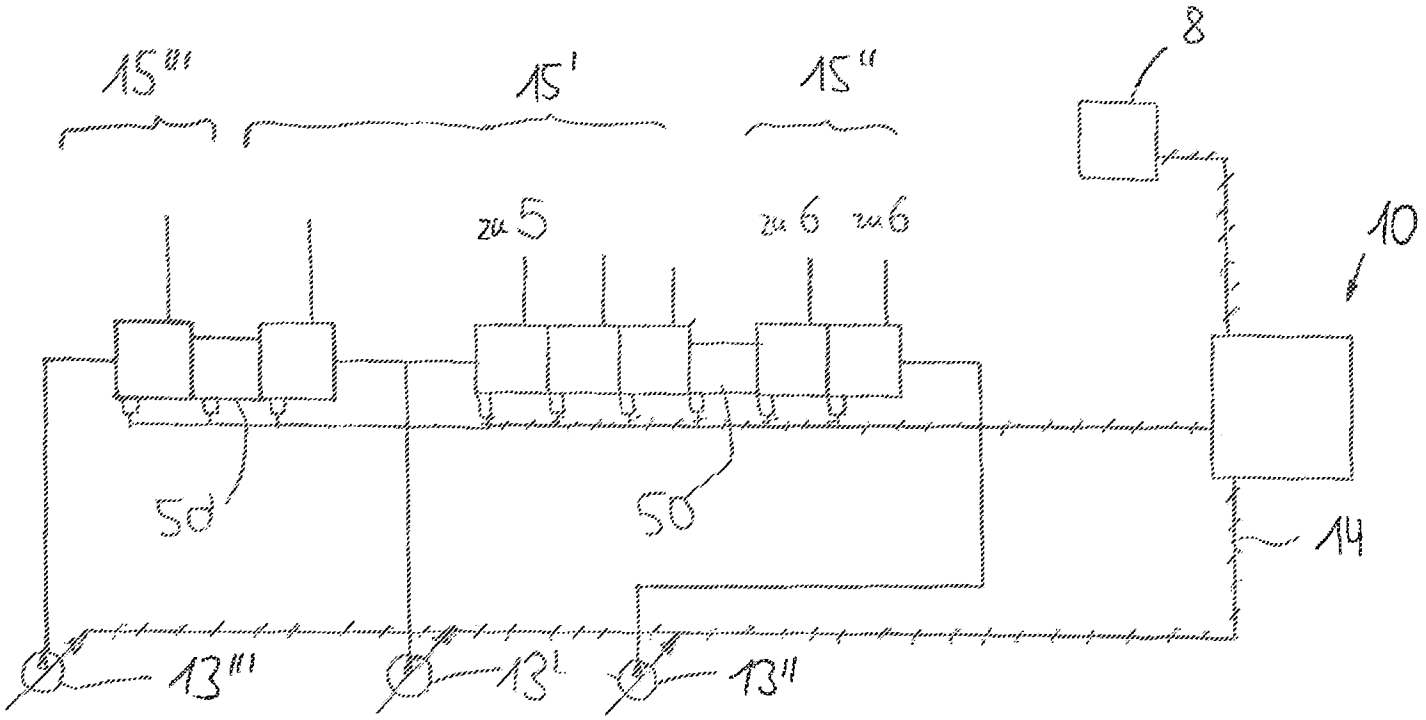
FIG. 4: another schematic view of the crane control system according to the invention.

FIG. 4 shows the solution with 3 pumps 13' and 13" and 13'" and with three independent load sensing systems. It is self evident that—upon short circuiting the various previously independent load sensing systems—the systems are no longer independent, but rather form a common load sensing system.

In the case shown in FIG. 4, the additional advantage can also be mentioned that most of the crane operations, including those most frequently used, are executed independently of one another. Even if the consequences of the actuation of a proportional valve 16 are slight, they are nonetheless present and can lead to reciprocal oscillations.

Thus, in principle at least two independent load sensing systems are created. If the crane actuators are now assigned to the two load sensing systems so that crane actuators that typically require a high hydraulic pressure p and other crane actuators that typically require high volumetric flow rate are connected together, then a relevant reduction in the power that is converted into heat can be achieved (also see formula).

The segmentation into the at least two split control blocks 15' and 15" can then always be used in order to save energy. It may also be possible that the crane operator has to actuate an "economy switch" to activate or deactivate the energy saving function according to the invention. This can be efficient if the crane operator is already aware that he will often require the high volumetric flow rate Q during upcoming lifting operations. In such a case he will not actuate the "economy switch".

It is also possible to use various pumps whose characteristics are matched to the special requirements of the assigned crane actuators. If the crane control system 10 determines that a load requires a higher volumetric flow rate Q than the assigned pumps 13' or 13" are able to produce, then the crane control system 10 first starts the pump that already has the lower hydraulic pressure p to match their hydraulic pressure p to the other pumps 13' or 13" and then opens the valve 50. In this way, both pumps 13' and 13" are available to supply the required volumetric flow rate Q. This is done at the expense of greater "power loss", but enables faster crane operations and thereby achieves savings in other areas. It is obvious that the transducer 8 is again used here.

The valve 50 is one that is either completely open or closed. Thus no losses arise within the valve 50. Since the required hydraulic pressure p has already been established, the opening or closing of the valve 50 is not perceptible or detrimental in any other way to the performance of the crane 1.

In any event, since the rotation of the revolving superstructure 3 is accomplished by a separate pump 13, three motions can be carried out simultaneously and without losses. Based on experience, the most frequently executed motions of the crane actuators are rotating, lifting and releasing the load, and luffing.

It should also be mentioned that with this solution the internal combustion engine 12 cannot be configured so that it can be switched off since, for example, the air conditioning compressor must still be powered. The fuel savings results only from the "combined load sensing pump controller".

The transducers 8 can be various sensors in the most diverse locations, e.g., pressure sensors, angle transducers, etc.

Figure 5:
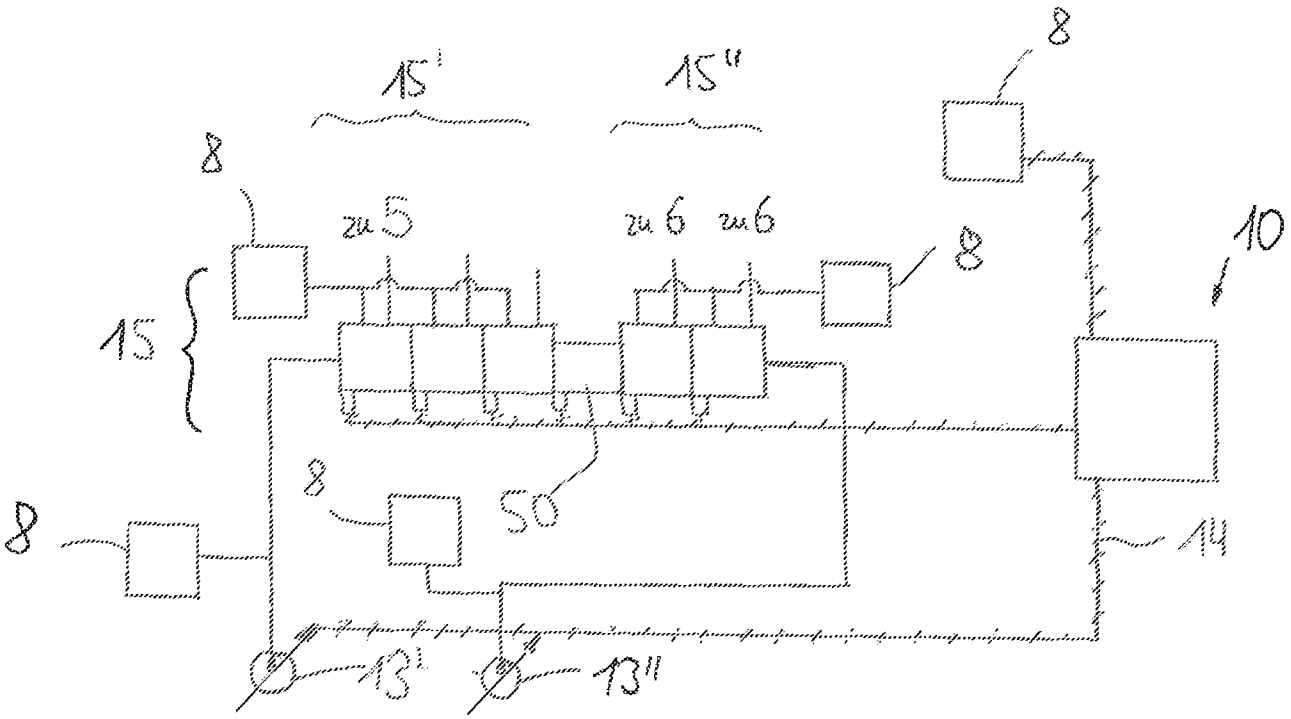
FIG. 5: another schematic view of the crane control system according to the invention.

FIG. 5 shows a solution in which the maximum pressure is measured by the transducers 8 in each of the at least two independent load sensing systems. If the valve 50 is now to be closed, the crane control system 10 then starts the at least two pumps 13 to set the higher of the two available hydraulic pressures p. The transducers 8 determine when the hydraulic pressure p is reached and reported back to the crane control system 10.

The invention claimed is:

1. A crane control system for controlling and/or for the hydraulic supply of hydraulic loads of a crane comprising:

at least one first pump and at least one second pump, at least one first split control block and at least one second split control block, by which at least one hydraulic load of the crane is respectively supplied with hydraulic medium, wherein the first pump is connected to the first split control block and is driven by a first hydraulic pressure, and wherein the second pump is connected to the second split control block and is driven by a second hydraulic pressure, wherein during certain engine operating conditions, the first or the second hydraulic pressure is equalized by a crane controller, wherein a respective lower hydraulic pressure is equalized to a higher hydraulic pressure and thereby increased.

2. The crane control system according to claim 1, wherein between the first split control block and the second split control block at least one valve is arranged by which the first split control block and the second split control block are hydraulically connected and disconnected, wherein at least one switch is provided by which the valve is actuated.

3. The crane control system according to claim 2, wherein at least one third pump and at least one third split control block is provided by which at least one hydraulic load of the crane is supplied with hydraulic medium, wherein the third pump is connected to the third split control block and is driven by a third hydraulic pressure.

4. The crane control system according to claim 3, wherein between the third split control block and the first split control block or the second split control block, at least one second valve is arranged, by which its third split control block is hydraulically connected and disconnected to the first split control block or the second split control block.

5. The crane control system according to claim 4, wherein at least one additional switch is provided by which the second valve is actuated.

6. The crane control system according to claim 3, wherein at least one crane controller is provided by which at least one first hydraulic pressure and at least one second hydraulic pressure is adjusted, wherein it is furthermore provided that the third hydraulic pressure is adjusted by the crane controller.

7. The crane control system according to claim 6, further comprising a revolving superstructure whose rotation is accomplished by the third pump.

8. The crane control system according to claim 1, wherein at least one hydraulic load of the crane is a crane actuator.

9. The crane control system according to claim 8, wherein the crane actuator is one or more of a rotating mechanism, a luffing cylinder, a winch, a telescoping drive mechanism, and a caterpillar drive.

10. The crane control system according to claim 1, further comprising an economy switch, wherein the crane controller does not equalize the first or the second hydraulic pressure when the economy switch is activated.

11. A crane, comprising:

a hydraulic supply of hydraulic loads;

a control system for controlling the hydraulic supply including at least one first pump and at least one second pump, at least one first split control block and at least one second split control block, by which at least one hydraulic load of the crane is supplied with hydraulic medium, wherein the first pump is connected to the first split control block and is driven by a first hydraulic pressure, and wherein the second pump is connected to the second split control block and is driven by a second hydraulic pressure, wherein during certain engine operating conditions, the first or the second hydraulic pressure is equalized by a crane controller, wherein a respective lower hydraulic pressure is equalized to a higher hydraulic pressure and thereby increased.

12. The crane according to claim 11, wherein between the first split control block and the second split control block at least one valve is arranged by which the first split control block and the second split control block are hydraulically connected and disconnected.

13. The crane according to claim 12, wherein the crane controller is provided by which at least one first hydraulic pressure and at least one second hydraulic pressure are adjusted.

14. The crane according to claim 12, wherein if the crane controller determines that a load requires a higher volumetric flow rate than the first and second pumps are able to produce, then the crane controller first starts one of the first and second pumps that already has lower hydraulic pressure to match one pump's pressure to another of the first and second pumps and then opens the valve.

15. The crane according to claim 12 wherein the hydraulic load of the crane includes a crane actuator.

16. The crane according to claim 15, wherein the crane actuator is a rotating mechanism.

17. The crane according to claim 15, wherein the crane actuator is a luffing cylinder.

18. The crane according to claim 15, wherein the crane actuator is a winch.

19. The crane according to claim 15, wherein the crane actuator is a telescoping drive mechanism.

20. The crane according to claim 15, wherein the crane actuator is a caterpillar drive.

* * * * *